United States Patent [19]

Markwardt

[11] Patent Number: 4,729,725

[45] Date of Patent: Mar. 8, 1988

[54] MOUNTING SYSTEM FOR SELECTIVELY MOUNTING CEILING FANS

[75] Inventor: Herbert W. Markwardt, Fort Worth, Tex.

[73] Assignee: Encon Industries, Inc., Fort Worth, Tex.

[21] Appl. No.: 913,475

[22] Filed: Sep. 30, 1986

[51] Int. Cl.[4] ..... F04B 17/00

[52] U.S. Cl. ..... 417/423 R; 416/244 R

[58] Field of Search ..... 417/423 L, 423 R, 423 S, 417/424 R, 361; 415/210; 248/343, 663; 416/244 R

[56] References Cited

U.S. PATENT DOCUMENTS

| | | | |
|---|---|---|---|
| 1,445,402 | 2/1923 | Le Velle . | |
| 1,583,864 | 5/1926 | Tucker . | |
| 2,924,417 | 2/1960 | Bodian | 248/343 |
| 4,073,598 | 2/1978 | Mizutani et al. | 416/5 |
| 4,342,073 | 7/1982 | Ranten | 362/294 |
| 4,402,649 | 9/1983 | Laurel | 416/5 |
| 4,422,824 | 12/1983 | Eisenhardt, Jr. | 416/5 |
| 4,448,388 | 5/1984 | Dennis et al. | 248/663 |
| 4,508,958 | 4/1985 | Kan et al. | 219/369 |
| 4,513,940 | 3/1985 | Alperin et al. | 248/343 |
| 4,538,973 | 9/1985 | Angott | 427/572 |
| 4,621,977 | 11/1986 | Markwardt | 416/5 |
| 4,634,345 | 1/1987 | Stanek et al. | 416/244 R |
| 4,640,668 | 2/1987 | Yang | 417/354 |

FOREIGN PATENT DOCUMENTS

| | | |
|---|---|---|
| 478417 | 1/1938 | United Kingdom . |
| 2031068A | 4/1980 | United Kingdom . |

OTHER PUBLICATIONS

Brochure "The Encon System" Encon Industries Inc., Forth Worth Texas, 7/1982.

*Primary Examiner*—Carlton R. Croyle
*Assistant Examiner*—Timothy S. Thorpe
*Attorney, Agent, or Firm*—Laney, Dougherty, Hessin & Beavers

[57] ABSTRACT

A variable mounting, electrically powered ceiling fan which includes a ceiling-attachable canopy which is adaptable to have the housing of the motor of an electrically powered ceiling fan attached directly thereto and positioned immediately therebelow, and is constructed to alternatively facilitate the suspension therefrom of a down rod which carries the fan motor housing at its lower end. In this latter arrangement, the ceiling fan includes a down rod which is swivelly supported from the lower side of the canopy, and includes a lower end which projects into, and is quick detachably connected to, a canopy sleeve located on the upper side of the motor housing of the ceiling fan. The down rod sleeve is sized to project into the opening of the lower side of the canopy which accommodates the down rod at a time when the down rod is removed from the assembly to facilitate direct attachment of the motor housing to the canopy.

3 Claims, 7 Drawing Figures

MOUNTING SYSTEM FOR SELECTIVELY MOUNTING CEILING FANS

FIELD OF THE INVENTION

This invention relates to a system for selectively mounting electrically powered ceiling fans, and more particularly, to a system for selectively mounting ceiling fans of the type which are supported from the ceiling within a room and utilize a canopy positioned adjacent the ceiling for support of the fan thereto.

BACKGROUND OF THE INVENTION

Brief Description of the Prior Art

Electrically powered ceiling fans are generally mounted to the ceiling of an enclosure in which the fan is to be employed, utilizing, in doing so, two different mounting methods. It has been necessary to manufacture and sell two different types of fans, each specifically adapted for installation by the use of a different method from that which is utilized in installing the other of the two types of fans.

In a room or other enclosure in which there is little head room due to a relatively low ceiling, it is usually desirable to employ flush mounting in securing the fan to the ceiling. A flush mounted fan is attached to the ceiling so that there is a relatively small space between the fan motor housing, and the blades carried thereby, and the ceiling. Although some sacrifice in efficiency is often experienced as a result of flush mounting of the fan so that the blades are nearer to the ceiling than is optimum, this type of mounting is necessary to enable the fan to be operated safely without danger of the blades striking persons in the room. Characteristically, flush mounted fans do not include a down rod, which is a usual subassembly employed in the second general catagory of fan which is adapted to be mounted to the ceiling in a different way.

Where down rod-suspended fans are employed, an elongated, veritcally extending down rod is utilized to interconnect the fan motor housing with a bracket by which the fan is secured to the ceiling. The down rod thus spaces the fan motor housing downwardly from six to twelve inches or more from the ceiling, and supports the fan motor housing and the fan blades at a location where a more efficient movement of the air is developed by the rotating blades. Generally, the down rod will be swivelly mounted in the canopy so that the assembly will accommodate some rocking or swaying motion of the fan housing and blades in the event slight unbalance should develop during usage, or the fan should be struck by some person or object therebelow.

It is believed that until the present time, a fan structure has not been proposed or offered which facilitates the optional installation of the fan in either a flush mode or a suspended down rod-type mounting, at the option of the purchaser. Such is very desirable because such a fan would not be limited in its installation to a particular size of room or ceiling height, and it would also facilitate placement transfer between rooms of a relatively high ceiling, and rooms of a relatively low ceiling, during its effective operating life.

BRIEF DESCRIPTION OF THE PRESENT INVENTION

The present invention proposes a dual mounting system to install an electrically powered ceiling fan having the capability of variable or selective mounting, whereby the fan can be mounted in either a flush mounted mode in which the motor housing is immediately adjacent the ceiling of the room in which the fan is mounted, or in a down rod suspended mode in which the motor housing is spaced downwardly from the ceiling.

Broadly described, the variably mountable, electrically powered ceiling fan of the invention includes a canopy assembly which is attachable to the ceiling, and is then optionally connected to either a down rod which is swivelly engaged with the canopy and projects downwardly therefrom, or with the motor housing of the fan if the fan is to be mounted in a flush mounted mode. The motor housing has secured to the upper side thereof a down rod receiving sleeve which is adapted to fit within the canopy for flush mounting. The canopy is secured by means of a plurality of fastening devices to a ceiling mounting plate.

An important object and purpose of the invention is to facilitate the combination of a down rod mounting system for a ceiling fan with a flush mounting system by combining both into one assembly so that either can be selectively utilized by the fan purchaser.

An important object of the invention is to provide an improved electrically powered ceiling fan which, because of the installation flexibility afforded by the fan accessory mounting system affords the purchaser of the fan the option of mounting it either by a flush mounting arrangement, where the ceiling of the room in which the fan is to be located is relatively low, or in a down rod suspended mode, in which the motor housing and fan blades are spaced downwardly from the ceiling for relatively efficient air circulation in instances where the head room within the enclosure where the fan is to be utilized facilitates such method of mounting.

A further object of the invention is to provide a ceiling fan which affords maximum utility for relatively little cost, and is constructed to allow the fan to be shifted from one location to another where the mounting requirements may differ, and to be placed in use at either location.

A further object of the invention is to provide an electrically powered ceiling fan which mechanically is ruggedly constructed, and affords a relatively long and trouble-free operating life.

Additional objects and advantages will become apparent as the following detailed description of a preferred embodiment of the invention is read in conjunction with the accompanying drawings which illustrate the invention.

GENERAL DESCRIPTION OF THE DRAWINGS

FIG. 1 is a side elevation view of a ceiling fan constructed in accordance with the present invention.

FIG. 2 is a detailed view of a portion of the ceiling fan shown in FIG. 1, illustrating a part of the motor housing and the switch housing suspended therebelow in side elevation, and illustrating the canopy, ceiling mounting plate and down rod portion of the ceiling fan in section. The fan blades and blade brackets have been removed from this detailed illustration of structure to afford greater clarity in the illustration and in the explanation of the fan structure.

FIG. 6, however, shows in detail a portion of the ceiling fan at a time when the ceiling fan is in its flush mounted status as depicted in FIG. 5.

DETAILED DESCRIPTION OF A PREFERRED EMBODIMENT OF THE INVENTION

Figure 1:
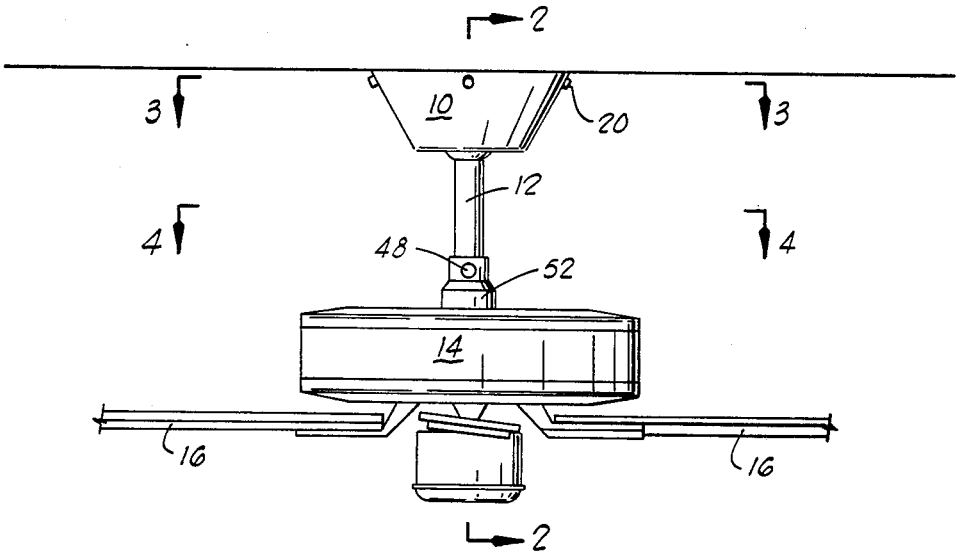

Referring initially to FIG. 1 of the drawings, the ceiling fan of the present invention illustrated therein is shown in its down rod supported status. In this mounting arrangement the fan blades rotate in a horizontal plane spaced downwardly by a substantial distance from the ceiling. The fan includes a canopy 10, a downwardly extending, elongated down rod 12 which is swivelly supported by one of its ends from the canopy, and a motor housing 14. A motor of conventional construction is disposed within the motor housing 14. The motor is drivingly connected to a plurality of substantially horizontally extending fan blades 16.

Figure 2:
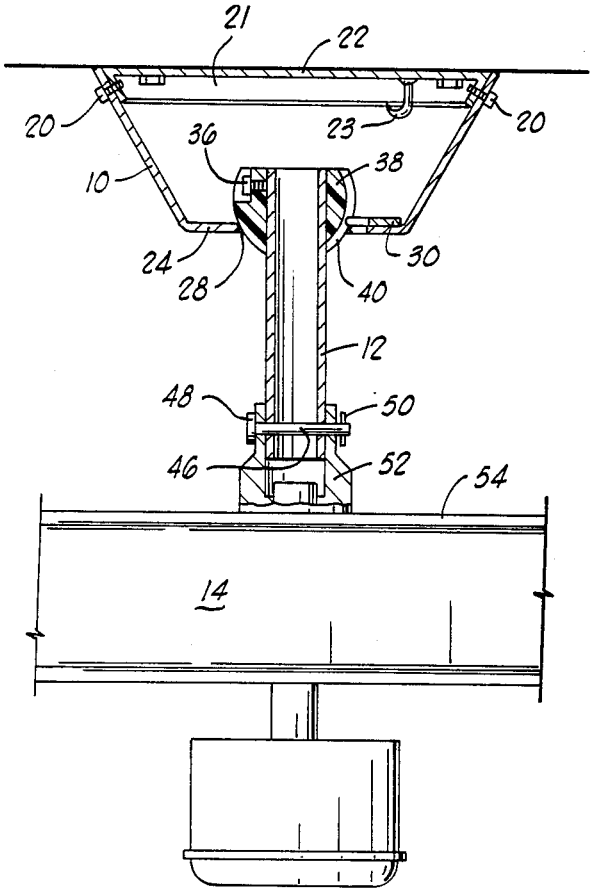
Figure 6:
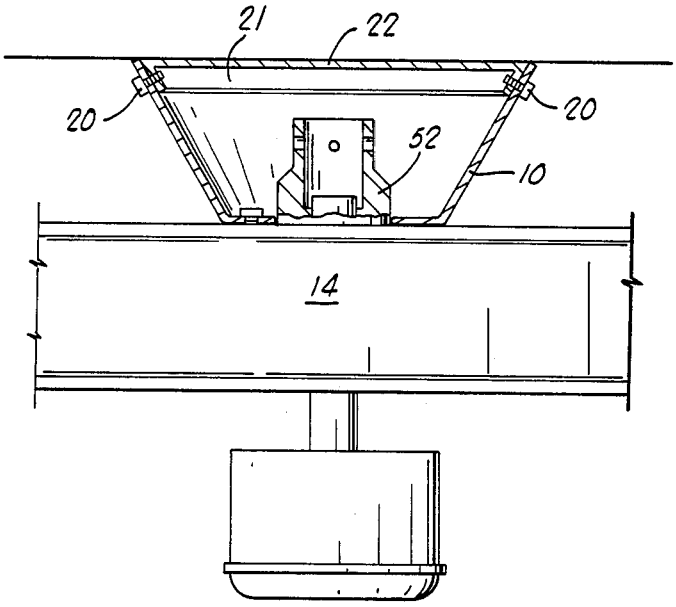
FIG. 6 is a view similar to FIG. 2, showing in detail a portion of the fan with a part of this portion being illustrated in elevation and a part in section.
Figure 7:
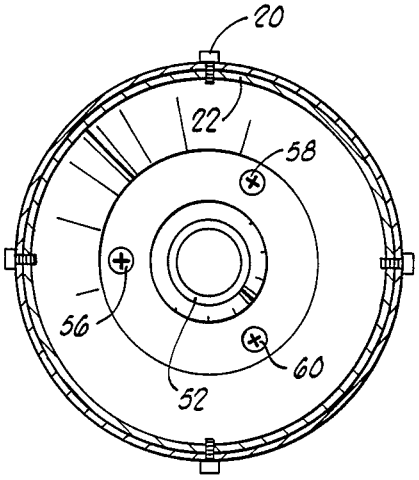
FIG. 7 is a sectional view taken along line 7—7 of FIG. 5.

Considering the fan construction in greater detail, the canopy 10 is a dished or concave plate of generally frustoconical configuration. In a preferred embodiment of the invention, the upper portion of the canopy 10 concentrically surrounds the projected longitudinal axis of the down rod 12 and defines a plurality of mounting screw holes (not visible). A plurality of mounting screws 20 project through the mounting screw holes and engage aligned screw holes in a ceiling mounting plate 22. The ceiling mounting plate 22 is secured to the ceiling and defines a central opening (not shown) through which electrical conductors are extended for extension through the hollow down rod in order to provide electrical power to the motor which powers the fan. The mounting plate 22 carries a downwardly projecting annular flange 21 around its outer periphery, as best illustrated in FIGS. 2 and 6. The mounting plate 22 also carries a downwardly extending J-hook 23. The J-hook 23 is used in conventional fashion for hanging the canopy of the fan from the point of the hook at a time when the electrical connections are to be made to the fan. The canopy is hung from the J-hook by passing the point of the J-hook through the screw holes 20, as is well understood in the art. The canopy 10 further includes a centrally located, relatively small diameter lower plate 24 which surrounds a central opening 28 into the canopy facilitating extension into the canopy of the upper portion of the down rod 12. A small, arcuate locking plate 30 is retained on the inner side of the canopy 10 adjacent the opening 28 by a pair of screws 32 which can be tightened to position the plate relative to the down rod 12 as hereinafter described. The screws 32 secure the locking plate 30 in a position for restraining the down rod in a manner hereinafter described, and these screws extend through holes 34 formed through the lower plate 24 of the canopy. Three of such holes 34 are provided.

At its upper end, the hollow down rod 12 has secured concentrically therearound by means of a set screw 36, a semispherical ball element 38. The ball element 38 can be suitably constructed of a synthetic resin, and is slidably mounted around the outer periphery of the down rod 12. The ball element 38 has a peripheral groove 40 in one side thereof.

Figure 3:
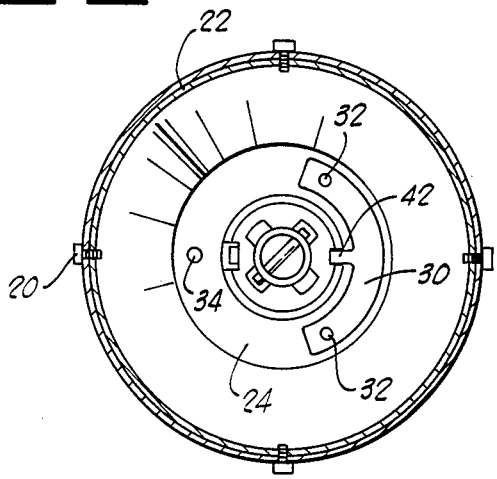
FIG. 3 is a sectional view taken along line 3—3 of FIG. 1.

In mounting the ceiling fan of the invention in a down rod supported status, the lower end portion of the down rod is first passed through the opening 28 through the center of the lower plate 24. The rod is moved downwardly until the ball element 38 comes to rest upon the inner side of the lower plate 24 of the canopy 10. Here the down rod 12 is arrested from further downward movement, and the ball enables the down rod to be swivelly supported within the canopy 10. In order to prevent the down rod 12 from rotating about its axis as the fan is energized and the blades turn in the conventional rotational movement, the locking plate 30 hereinbefore described is provided with a centrally located, inwardly projecting tongue 42 which copperates with the peripheral groove 40 on the semi-spherical ball element 38 in the manner shown in FIGS. 2 and 3. This keying engagement prevents the down rod 12 and the semi-spherical ball element 38 carried thereon from rotating about the axis of the hollow down rod.

At its lower end, the hollow down rod 12 has formed therethrough, a pair of aligned openings located at opposite sides of the down rod along a diameter thereof for the purpose of receiving a locking pin, designated by reference numeral 46. The locking pin 46 carries a head 48 at one end thereof and is locked in position by means of a cotter pin 50 at its other end. The locking pin is used for locking the lower end of the down rod 12 into an upwardly extending tubular down rod sleeve 52.

Figure 4:
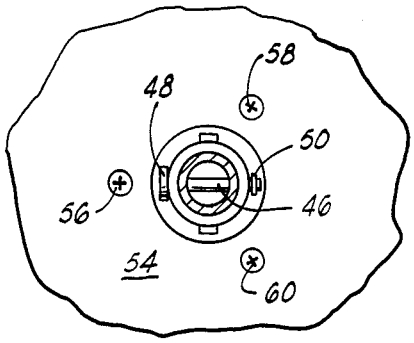
FIG. 4 is a sectional view taken along line 4—4 of FIG. 1.
Figure 5:
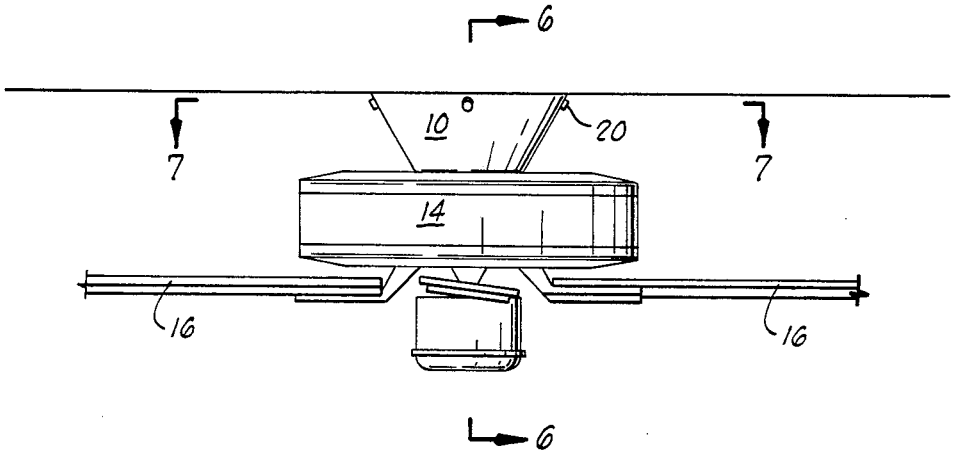
FIG. 5 is a side elevation view of the ceiling fan of the present invention, but depicting the ceiling fan in a flush mounted status in which the down rod has been removed and the motor housing of the fan is attached directly to the canopy.

The down rod sleeve 52 is secured to a top plate 54 carried at the upper side of the fan motor housing 14. The top plate 54 is provided with three screw or fastener openings 56, 58 and 60 as shown in FIG. 4. These openings surround the down rod sleeve 52 at a location which allows them to register with the three holes 34, formed through the lower plate 24 of the canopy at a time when it is desired to use the flush mounting mode of mounting the fan to the ceiling.

When the fan is to be mounted flush to the ceiling, the down rod 12 is removed from the system by first removing the pin 46. This is accomplished, of course, by pulling the cotter pin 50 out and extracting the pin from the sleeve 52 and from the registering openings through the down rod 12. The down rod 12 can then be lifted out of the sleeve 52. It can be further lifted upwardly to remove it from the canopy 10, since the lower end of the down rod will pass easily through the opening 28 in the bottom plate 24 of the canopy. After the down rod has been removed, the canopy is then moved downwardly so that it passes down around and over the down rod sleeve 52, and the lower plate 24 comes to rest on the upper side of the top plate 54 of the fan motor housing 14. The canopy can then be rotated until the fastener holes 34 formed through the lower plate 24 thereof register with the three holes 56, 58 and 60 formed through the top plate 54 of the fan motor housing 14. At or prior to this time, the two fasteners or screws used to hold the small arcuate locking plate 30 in place are removed, and the locking plate is also removed. Alternatively, in another embodiment of the invention, the locking plate can be left in its locking position after removal of the down rod 12, and the same screws used to hold the locking plate in position can be further used to attach the canopy to the top plate 54 of the housing 14 by extension of the screws or fastening devices used to hold the locking plate on downwardly through two of the openings or holes in the top plate.

From the foregoing description of the invention it will be perceived that it is quite easy to quickly mounting the ceiling fan of the invention, either by the use of a flush mounted mode of securement to the ceiling, or in the down rod support position. In either event, the mounting of the fan can be quickly and easily accomplished without special skills and without the use of complicated or expensive tools. Moreover, by saving the down rod if the fan is initially flush mounted, the fan can be later shifted to a different location where a down rod mounting procedure can be employed.

Although a preferred embodiment of the fan of the present invention has been illustrated and herein described for purposes of exemplification, it will be understood that various changes in the described structure can be made without departure from the basic principles which underlie the invention. Changes of this type are therefore deemed to be circumscribed in the spirit and scope of the invention, except as the same may be necessarily limited by the appended claims, or reasonable equivalents thereof.

What is claimed is:

1. A ceiling fan adapted for selective mounting flush to the ceiling, or alternatively, suspended upon a down rod comprising:

a horizontally extending ceiling mounting plate having a downwardly extending annular flange around the outer periphery thereof, said flange defining a plurality of screw holes therethrough;

a concavo-convex canopy having screw holes therethrough and including a centrally apertured lower central plate, said lower central plate having a plurality of upper fastener holes formed therethrough in spaced array about the aperture through the center of said central plate;

a plurality of mounting screws extending through said screw holes in the canopy and into engagement with the screw holes in the downwardly extending flange of the ceiling mounting plate;

a J-hook projecting down from the ceiling mounting plate from a location within the downwardly extending flange and having a canopy-suspending point thereon of a size to pass through the screw holes in the canopy and facilitating hanging of the canopy therefrom to effect electrical connections to the fan;

a down rod assembly removably connected to the canopy and projecting downwardly therefrom, said down rod assembly including:

an elongated tubular down rod having an upper end extending through the central aperture in said lower central plate and having a lower end;

a ball element within said canopy detachably secured to the upper end of said down rod for swivelly supporting said down rod suspended from said canopy; and a down rod sleeve receiving the lower end of said down rod and sized to project through the aperture in the lower central plate of said canopy when said fan is mounted in said flush mounting mode;

a fan motor housing having a top plate beneath, and secured to, and supporting, said down rod sleeve, said fan motor housing top plate having a plurality of lower fastener holes therethrough vertically aligned with said upper fastener holes in said central plate of said canopy; and means for interengaging said lower central plate of said canopy to the top plate of said fan motor housing with said down rod sleeve projecting into said canopy through the central aperture in said lower central plate at a time when the down rod and ball element are removed to facilitate flush mounting of the fan, said interengaging means comprising a plurality of fasteners removably carried in said lower fastener holes through said motor housing top plate, and sized to pass through the upper fastener holes in said central plate of said canopy.

2. A ceiling fan as defined in claim 1 and further characterized as including locking plate means removably secured to the inner side of said canopy adjacent the central aperture in said lower central plate and engageable with said ball element to prevent said down rod and ball element from rotating about the longitudinal axis of the down rod.

3. A ceiling fan adapted for selective mounting flush to the ceiling, or alternatively, suspended upon a down rod comprising:

a horizontally extending ceiling mounting plate having a downwardly extending flange at the outer periphery thereof, said flange defining a plurality of screw holes therethrough;

a concavo-convex canopy having screw holes therethrough and including a centrally apertured lower central plate, said lower central plate having a plurality of upper fastener holes formed therethrough in spaced array about the aperture through the center of said central plate;

a plurality of mounting screws extending through said screw holes in the canopy and into engagement with the screw holes in the downwardly extending flange of the ceiling mounting plate;

a reverse-turned hook projecting down from the ceiling mounting plate at a location within the downwardly extending flange and having a canopy suspending point thereon facilitating hanging of the canopy therefrom temporarily at a time when electrical connections to the fan are to be established;

a down rod assembly movably connected to the canopy and projecting downwardly therefrom, said down rod assembly including:

an elongated tubular down rod having an upper end extending through the central aperture in said lower central plate and having a lower end;

a ball element within said canopy detachably secured to the upper end of said down rod for pivotally supporting said down rod suspended from said canopy; and a down rod sleeve receiving the lower end of said down rod and sized to project through the central aperture in the lower central plate of said canopy when said canopy is mounted in said flush-mounting mode;

a fan motor housing having a top plate beneath, and secured to, and supporting, said down rod sleeve, said fan motor housing top plate having a plurality of lower fastener holes therethrough vertically aligned with the upper fastener holes in said central plate of said canopy; and means for interengaging said lower central plate of said canopy in flatly abutting contact with the top plate of said fan motor housing, with said down rod sleeve projecting into said canopy through the central opening in said lower plate at a time when the down rod and ball element are removed to facilitate flush mounting of the fan, said interengaging means comprising a plurality of fasteners removably carried in said lower fastener holes through said motor housing top plate, and sized to pass through the upper fastener holes in said central plate of said canopy.

* * * * *